United States Patent [19]

Klamer

[11] Patent Number: 4,941,665

[45] Date of Patent: Jul. 17, 1990

[54] ROTATOR GAME DEVICE

[76] Inventor: Reuben B. Klamer, 828 Prospect St., La Jolla, Calif. 92037

[21] Appl. No.: 301,816

[22] Filed: Jan. 25, 1989

[51] Int. Cl.[5] ..... A63F 5/04

[52] U.S. Cl. ..... 273/142 H; 273/142 R; 273/142 D; 273/142 E

[58] Field of Search ..... 273/141 R, 142 R, 142 D, 273/142 E, 142 F, 142 H, 142 HA; 206/315.1

[56] References Cited

U.S. PATENT DOCUMENTS

| | | | |
|---|---|---|---|
| 362,611 | 5/1887 | Davis | 273/287 |
| 1,167,407 | 1/1916 | Johnson | 273/141 R |
| 1,520,697 | 12/1924 | Carlson | 273/142 F |
| 3,306,462 | 2/1967 | Da Cruz | 273/148 R X |
| 4,291,881 | 9/1981 | Klamer | 273/142 H |
| 4,732,386 | 3/1988 | Rayfiel | 273/142 H |

*Primary Examiner*—Edward M. Coven
*Assistant Examiner*—Raleigh W. Chiu
*Attorney, Agent, or Firm*—Irell & Manella

[57] ABSTRACT

A rotator game device for the generation of randomly selected data has a circular housing with a recess, and a base wheel rotatable within the housing recess upon a bearing arrangement. The base member has an upstanding handle member fitting over the bearing arrangement, and a circular retainer member having an inclined surface and a lip is mounted to the circular housing. A collar member is fitted to the upstanding handle member and has a plurality of detents as well as an indicia indicator for each detent area. A plurality of wheel or disc members carrying indicia such that each wheel member has one edge resting on the circular retainer and one edge resting on the base wheel. When the base wheel is stationary the plurality of wheel members are urged under the influence of gravity to nested relationship in the detents of the collar member, and when the base wheel is rotating the wheel members are displaced outwardly under the influence of centrifugal force such that their outer edge contacts the lip of the circular retainer, causing the wheel members to revolve in the direction of movement of the base wheel while counter rotating with respect to the direction of their revolution and the direction of rotation of the base member. Storage compartments can be provided for storing the wheels or discs, and the storage compartments can be made rotatable for use in game play in selecting particular sides of wheels or discs to come into game play.

12 Claims, 2 Drawing Sheets

ROTATOR GAME DEVICE

BACKGROUND OF THE INVENTION

This invention pertains to a rotating game device for randomly selecting data, which can be used as part of a variety of different games, including strategy games, games of chance, television game shows and the like.

This invention is an improvement on a "Kaleidoscopic Game Device" which is the subject of U.S. Pat. No. 4,291,881, granted on Sept. 29, 1981 to the same inventor as the present invention. As pointed out in that prior patent, devices to randomly select numbers or other data have been utilized in games throughout the history of mankind. Dice and simple spinners are commonly used for this purpose. Due, however, to the relative simplicity of such apparatus, they are capable of generating only a limited amount of data. Moreover, such apparatus are not that visually interesting. In prior U.S. Pat. No. 4,291,881 referred to above, there is disclosed and claimed an arrangement in which a plurality of small wheels bearing indicia rest upon the surface of a base wheel and are captured in a circular housing. Random data is generated by spinning the base wheel. The torque of this motion causes the smaller wheels to spin in the opposite direction. When everything comes to rest, a centrally located indicator points to data on one of the small wheels to select indicia thereon as part of a game play or the like.

OBJECTS AND SUMMARY OF THE INVENTION

The present invention relates to an improved data selection apparatus, in which a number of smaller wheels bearing indicia are provided which counter-rotate to a base wheel. An object of the present invention is to provide such an arrangement in which the smaller wheels are easily removable, so that the apparatus can be adapted for use in a variety of games, and can also be utilized in a game in which a part of the game play and/or strategy involves bringing different wheels bearing different indicia into and/or out of play in connection with the base wheel. It is a further object of the present invention to provide such apparatus which includes storage means for storing the smaller wheels which are used in the apparatus, as well as being useful for, e.g. selecting which side of a smaller wheel shall be operative when the wheel is placed into play by contacting it into the base wheel of the apparatus.

Briefly, in accordance with one embodiment of the invention, a rotator game device for the generation of randomly selected data includes a housing, a base member rotatable within the housing and having a plurality of centrally located detents or collars, a retainer member having a circular inclined surface and a retaining lip, and a plurality of removable wheels carrying indicia and having one edge supported on the base member and the other edge supported on the inclined surface of the retainer member. When the base member is at rest, the wheels are nested under the influence of gravity in the detents of the base member, and when the base member is rotating the wheels are displaced outwardly and up the inclined surface of the retainer member to contact the retaining lip under the influence of centrifugal force, resulting in counter rotation of the wheels until centrifugal force decreases to the point where they fall under the influence of gravity back to the detents in the base member.

Other objects and advantages of the present invention will appear from the following detailed description of a preferred embodiment of the invention, taken in conjunction with the accompanying drawings.

BRIEF DESCRIPTION OF THE DRAWINGS

FIG. 9 is an enlarged cross sectional view of an embodiment of the removable wheels or discs of the present invention.

DETAILED DESCRIPTION OF A PREFERRED EMBODIMENT

Figure 1:
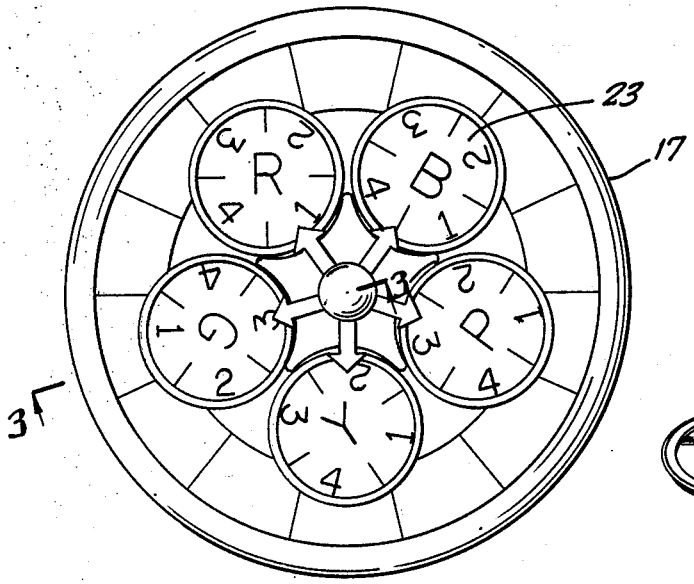
FIG. 1 is a top plan view of the apparatus of one embodiment of the invention at rest, with the smaller wheels in contact with a central member which includes locating collars and indicia selecting means.
Figure 2:
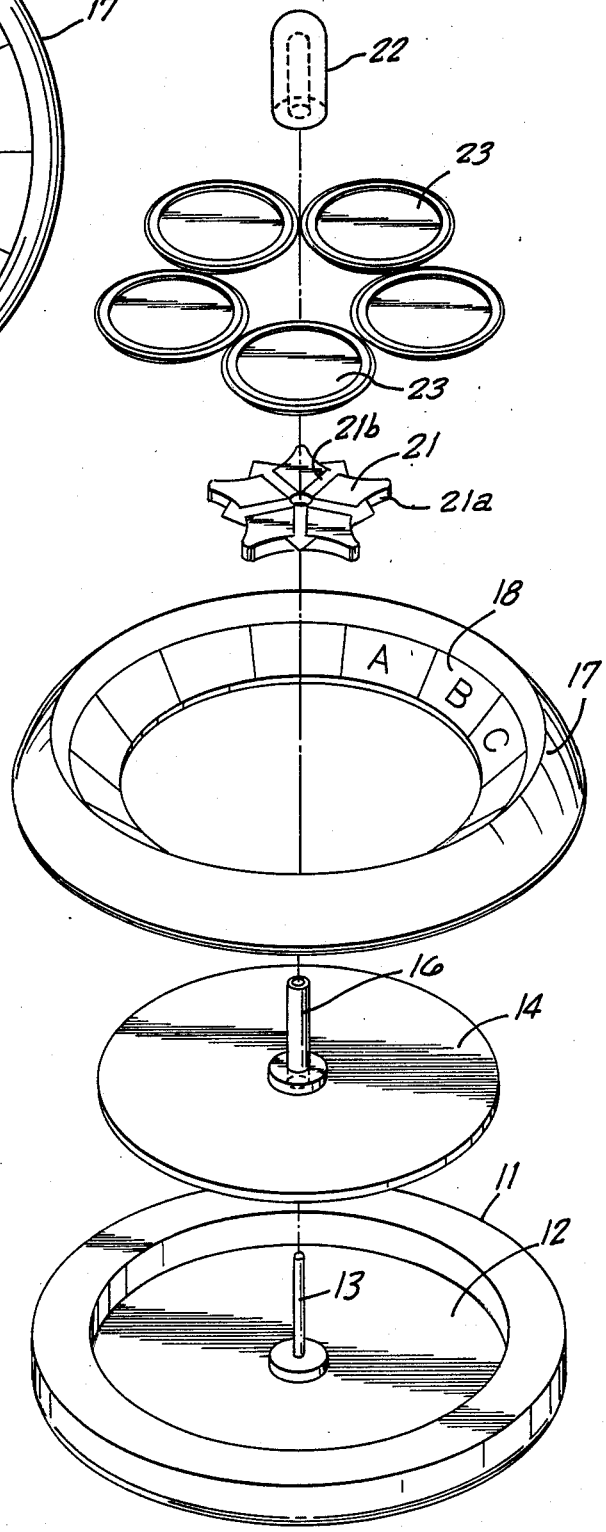
FIG. 2 is an exploded view of the mechanism of FIG. 1, showing the interrelationship of the various elements of the mechanism.
Figure 3:
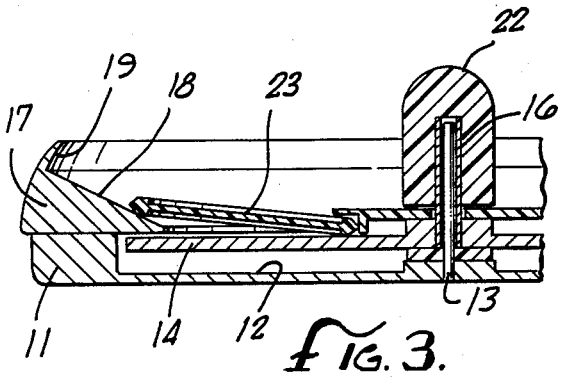
FIG. 3 is a partial cross-sectional view taken along the line 3—3 in FIG. 1.

Turning now to the drawings, particularly FIGS. 1 through 5, the present invention includes a circular housing 11, which as shown has a recessed area 12 closed at its bottom and open at its top. A needle bearing 13 is fixed to the center of the recessed area 12 of the circular housing 11 on its bottom, and extends upwardly. A circular base wheel 14 has an upstanding handle member 16 which is hollow, and which fits over the needle bearing 13 to mount the circular base wheel 14 for rotational movement with respect to the circular housing 11. A circular retainer member 17 is provided suitably attached by adhesive or fasteners to the circular housing 11. The circular retainer has an upwardly inclined surface 18, and a retaining lip 19 (FIG. 3).

As shown in FIG. 2, in one embodiment of the invention a collar/indicator member 21 is suitably mounted to the upstanding handle member 16, by adhesives, force fit or other suitable means. The member 21 is provided with a series of detents 21*a*, and a series of indicia indicating means, in this case pointers 21*b*. As shown in FIG. 2, a handle 22 holds the member 21 onto the upstanding handle member 16. A plurality of removable wheels or discs 23 are provided. As shown in FIG. 3, these wheels or discs 23 are positioned in the rotator game device such that each wheel or disc has one of its edges nested into one of the detents 21*a* and resting on the circular base wheel 14, and its opposite edge resting on the inclined surface 18 of the circular retainer member .

As generally indicated in the drawings, each of the removable wheels or discs 23 has indicia thereon. The exemplary indicia shown in FIG. 1 is simple numbers on different colored wheels (red, blue, green, yellow, purple), but obviously the indicia can be drawings, letters, characters or any other kind of visible indicia that might enter into playing considerations for any of a variety of strategy or skill games. In accordance with the invention, the wheels or discs can have different indicia on opposite sides, and the wheels or discs are easily reversible so as to expose either side. In the particular embodiment shown in the drawings, the game apparatus is shown as including five separate removable discs or wheels, with a corresponding number of the detents 21*a* and pointers 21*b*. Clearly, more or less than five removable wheels can be provided. It is also a part of the invention that the total game apparatus can include a number of wheels or discs that are in excess of the number that will fit at any one time in the game apparatus. That way, the apparatus is useful in games wherein the strategy or game play depends upon which of the various discs or wheels are contained in the rotator apparatus at any particular time. Preferably, the wheels or discs have surface features on their edges, such as ridges 24*a* or interlocking dimples 24*b* as shown in FIG. 9, which facilitate "stacking" of the wheels or discs as might be useful in particular games.

If desired, the inclined surface 18 of the circular retainer 17 can also be provided with indicia that enters into or determines game play. This is generally indicated in FIG. 2, showing simple divisions of this surface bearing alphanumeric designations. As in the case of the discs or wheels 23, the indicia on the inclined surface of the circular retainer can be virtually anything that enters into or determines game play for a game with which the apparatus might be associated.

Figure 4:
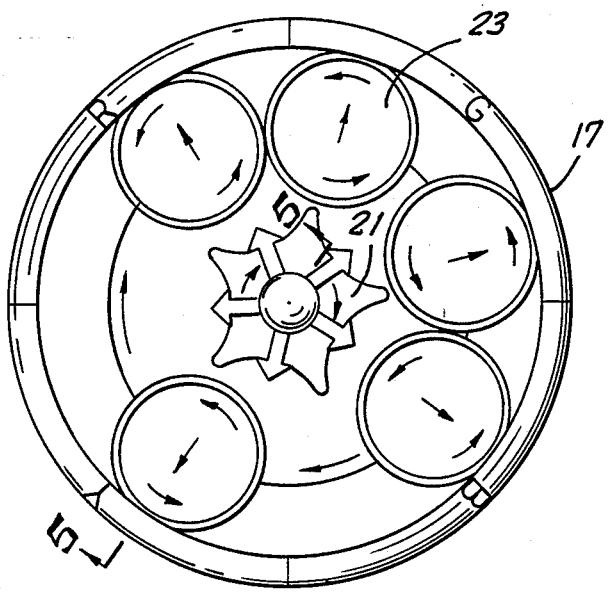
FIG. 4 is a top plan view similar to FIG. 1 showing the apparatus in motion, with a base wheel rotating and the smaller wheels counter-rotating.
Figure 5:
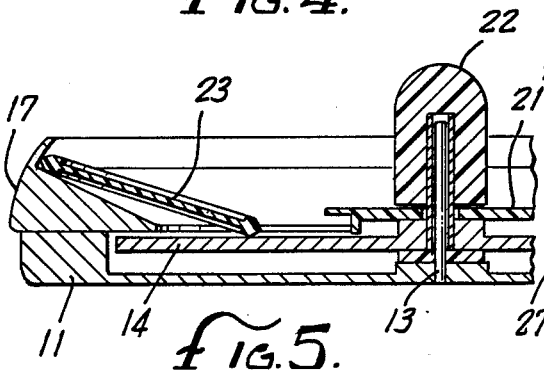
FIG. 5 is a cross sectional view taken along the line 5—5 in FIG. 4.

The operation of the invention in accordance with FIGS. 1 through 5 will now be described. When the apparatus is at rest or stationary, the relative juxtaposition of the elements is as shown in FIGS. 1 and 3. That is, the removable wheels or discs 23 are nested in the detents 21*a*, with the pointer elements 21*b*pointing to a particular area on each wheel or disc. The apparatus is activated by manually grasping the handle member 22, to spin the circular base wheel 14. As the base wheel 14 in spun in one or the other direction, each of the discs or wheels 23 are caused to counter rotate, or spin in the direction opposite to that of base wheel 14. Further, the centrifugal force resulting from the spinning of the base wheel 14 and the counter rotation of the discs or wheels 23, causes the discs or wheels 23 to spin up the inclined surface 18 of the circular retainer member, as shown in FIGS. 4 and 5, with the wheels or discs 23 contacting the retaining lip 19. The wheels or discs 23 still have one of their edges in contact with base wheel 14 in FIGS. 4 and 5. This causes the wheels or discs 23 to be physically revolved around the circular retaining member in the same direction as the rotation of the base wheel, while each individual disc is at the same time rotating in the opposite direction because of contact of each individual disc edge with the retaining lip 19. This combination of motion increases the randomness of the final disc or wheel orientation and leads to interesting visual effects, which can obviously be quite varied by providing a variety of indicia on the wheels or discs.

In FIG. 4 the top outer surface of the circular retainer is shown divided into segments labeled R, G, B and Y. This is just to indicate that, if desired, particular indicia or color segments can be provided on this surface (and/or the surface can be extended to a wider with a pointer or pointers on the width) to cooperate indicator member 21 as a part of game play.

As the base wheel 14 slows down, the discs or wheels 23 also obviously slow down, and finally fall under the influence of gravity back down the inclined surface 18, ending up nesting in the detents 21*a* with the pointers 21*b* pointed to a particular area or indicia on each one of the wheels or discs, as shown in FIGS. 1 and 3.

Of course, it should be understood that FIGS. 1 through 5 only illustrate one embodiment of the invention. For example, provision could be made for rotating the base wheel 14 by a small electric motor or the like, instead of manually. As another example, fewer of the pointers 21*b* could be provided than there are wheels or discs, so that which disc or wheel the pointer or pointers end up pointed at forms a part of the game play. Although various plastics are an obvious choice for materials for the various rotator elements, other materials such as wood and metal are also suitable. Clearly, the apparatus can also be constructed in a variety of scales, from a relatively small table-top unit that is part of a game that might also involve a board or the like, to a very large unit that might be used, for example, on a television game show. The apparatus could also be useful as an amusement park ride. Also, mechanical type pointers are illustrated in the drawing for selecting or indicating one of the various areas or indicia on the wheels or discs 23. It would also be suitable to provide lighting elements adjacent the detents to cooperate with translucent areas on the discs or wheels, to illuminate the selected areas or indicia on the wheels or discs. Thus, when the term "pointer means" is used, it is intended to refer to any mechanical, optical or electrical mechanism for selecting indicia or areas of the wheels or discs. These and many other variations are possible without departing from the basic tenets of the present invention.

Figure 6:
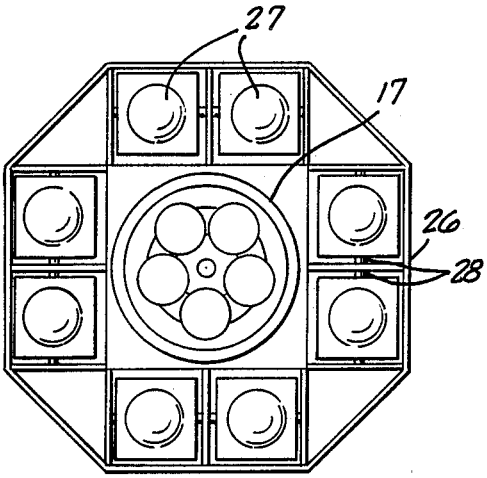
FIG. 6 is a top plan view of another embodiment of the invention in which storage/disc side selector mechanisms are provided.
Figure 7:
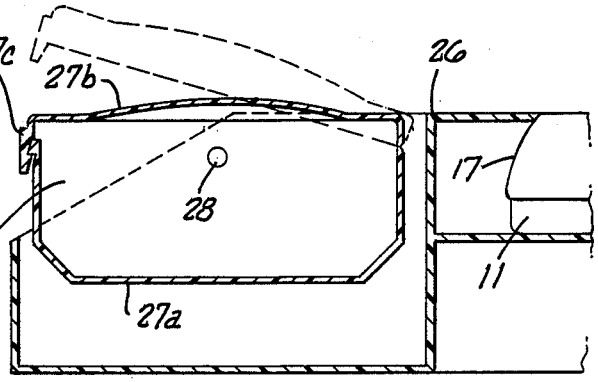
FIG. 7 is a cross section view of one of the storage/-disc side selector mechanisms of FIG. 6, illustrating the hinged top for inserting and retracting discs.
Figure 8:
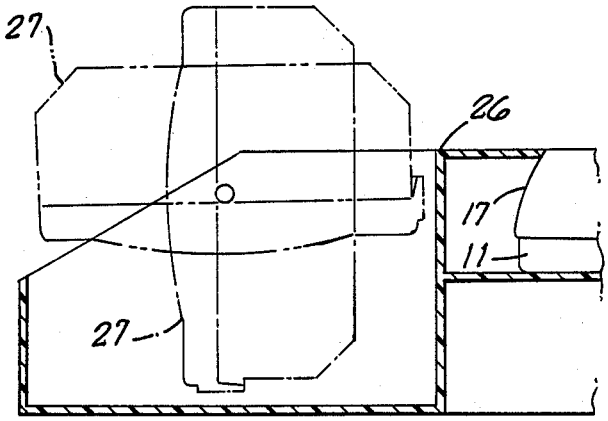
FIG. 8 is a cross sectional view similar to FIG. 7, but illustrating the rotational mounting of the storage/selector mechanism for randomly selecting a disc side.

Turning now to FIGS. 6 through 8, there is illustrated another embodiment of the invention in which storage compartments can be provided for the wheels or discs 23, and such compartments can actually enter into and be a part of game play. As shown in FIG. 6, for example, an extended base 26 can be provided, with the apparatus of FIGS. 1 through 5 centrally mounted in the extended base, as shown in FIG. 6. In the particular embodiment shown in FIGS. 6 through 8, there are shown a plurality (eight) storage compartments 27 disposed around the periphery of the extended base 26. In this particular embodiment, each of the storage compartments 27 has a body 27*a* and a hinged lid 27*b*, suitably arranged to snap shut on the body through a snap lip 27*c*. Also, as shown in FIGS. 7 and 8, each of the storage compartments is mounted via pivots 28 to the extended base 26, such that the entire storage compartment can be rotated or revolved.

In operation, the storage compartments 27 can clearly be used for storage of the wheels or discs 23 when the rotator game device is not in use. Also, the storage compartments can be used for storage of wheels or discs while the rotator game device is in use, for example in a game where there are more wheels or discs than will fit at any one time in the rotator apparatus. As mentioned previously, the apparatus of this invention is applicable to game play where the particular wheels or discs which are placed in the rotator device forms a part of the game play, with for example part of the game play being determining which wheels or discs are in the rotator apparatus, either through strategy or chance.

The "rotatable" storage compartments as shown in FIGS. 6 through 8 enable yet another element of game play. Specifically, one or more wheels or discs can be placed in the storage compartments, and the storage compartments rotated so as to randomly expose one or the other of the two sides of each wheel or disc. Alternatively, other dimensional objects (i.e. figures, toy cars and the like) can be placed in the storage compartments. This can clearly also form a part of the game play for whatever game is utilizing the apparatus of this invention.

The variety and makeup of games with which the apparatus of this invention may be used is limited only by the creativity and imagination of a game developer. That is, the rotator game apparatus of this invention may in essence comprise an entire game, by constructing rules and a game play outline related to the wheels or discs 23, their indicia, etc. Alternatively, the rotator game apparatus of this invention may be a portion of a game that includes a board and/or cards and the like, with the rotator apparatus entering into game play in determining turns, advances, chance alternatives or the like. For example, selecting which of a player's wheels or discs are placed in the rotator apparatus could be a function of the player's game strategy, with obviously the indicia selected on the wheels being a function of chance in spinning the rotator game apparatus.

Although the present invention has been described in terms of particular embodiments, it should be clear that many other embodiments and alternatives are within the scope of the invention. Therefore, the description of the embodiments should not be considered restrictive, and the appended claims should be referred to in determining the scope of the present invention.

I claim:

1. A rotator game device for the generation of randomly selected data comprising a housing, a base member rotatable within said housing and having a plurality of centrally located detents or collars, a retainer member at the top of said housing overlying part of said base member without contacting the same and having a circular inclined surface and retaining lip, and a plurality of removable wheels carrying indicia and having one edge supported on the base member and the other edge supported on the inclined surface of said retainer member in a spaced relationship from said retaining lip, such that when the base member is at rest the wheels are nested under the influence of gravity in the detents of the base member, and when the base member is rotating the wheels are displaced outwardly and up the inclined surface of the retainer member to contact the retaining lip under the influence of centrifugal force, resulting in the wheels revolving in the direction of movement of said base member with respect to said housing and said retainer member while individually counter rotating until centrifugal force decreases to the point where they fall under the influence of gravity back to the detents in the base member.

2. A rotator game device in accordance with claim 1 wherein indicia indicating means are provided as part of the detents to select at least one indicia on at least one of the wheels when the wheels are nested in said detents.

3. A rotator game device in accordance with claim 2 wherein a plurality of indicia indicating means are provided as part of said detents so as to simultaneously select indicia on a plurality of said wheels.

4. A rotator game device in accordance with claim 1 wherein said removable wheels are provided with indicia on both their surfaces, so that the indicia on one or the other of the surfaces of the wheels are brought into game play, depending upon which surface is visible when the wheels are in position in the game device.

5. A rotator game device in accordance with claim 1 including a number of removable wheels which exceeds the number of wheels which can be positioned in the device at any one time, whereby selection of which wheels are placed in the device can be a part of game play.

6. A rotator game device in accordance with claim 1 wherein said retainer member is also provided with indicia around its periphery or retaining lip which can be part of game play.

7. A rotator game device in accordance with claim 1 wherein said wheels are provided with ridges or dimples around their periphery so as to be easily stackable.

8. A rotator game device in accordance with claim 1 wherein said housing includes a plurality of removable wheel storage compartments for storing the removable wheels or other dimensional objects forming a part of the rotator game device.

9. A rotator game device in accordance with claim 8 wherein the removable wheel storage compartments have hinged tops and wherein the storage compartments are themselves hinged to said housings, whereby the storage compartments may be rotated to randomly tumble wheel members contained therein to select one or the other side of the wheel members as a part of game play.

10. A rotator game device for the generation of randomly selected data comprising a circular housing having a circular recess, a base wheel rotatable within said housing recess upon bearing means carried by said housing, said base member having an upstanding handle member fitting over said bearing means, a circular retainer member at the top of said circular housing above said recess, said circular retainer extending inwardly in a non-contacting relationship with said base wheel and having an inclined surface and retaining lip, a collar member fitted to the upstanding handle member and having a plurality of detents, and a plurality of smaller wheel members carrying indicia and being located such that each wheel member has one edge resting on said circular retainer in a spaced relationship from said retaining lip and one edge resting on said base wheel, whereby when said base wheel is stationary the plurality of wheel members are urged under the influence of gravity to nested relationship in the detents of said collar member, and when said base wheel is rotating said wheel members are displaced outwardly under the influence of centrifugal force such that their outer edge contacts the retaining lip of said circular retainer, causing the wheel members to revolve in the direction of movement of said base wheel with respect to said housing and said circular retainer while counter rotating with respect to the direction of their revolution and the direction of rotation of said base member.

11. A rotator game device for the generation of randomly selected data comprising a housing, a base member rotatable within said housing and having a plurality of centrally located detents or collars which includes a plurality of indicia indicating means being adapted to simultaneously select indicia, a retainer member having a circular inclined surface and a retaining lip, and a plurality of removable wheels carrying indicia and having one edge supported on the base member and the other edge supported on the inclined surface of said retainer member, such that when the base member is at rest the wheels are nested under the influence of gravity in the detents of the base member and spaced from said retaining lip, and when the base member is rotating the wheels are displaced outwardly and up the inclined surface of the retainer member to contact the retaining lip under the influence of centrifugal force, resulting in the wheels revolving in the direction of movement of said base member while individually counter rotating until centrifugal force decreases to the point where they fall under the influence of gravity back to the detents in the base member.

12. A rotator game device in accordance with claim 11, wherein said retainer member is also provided with indicia around its periphery or retaining lip which can be part of game play.

* * * * *